US008952623B2

(12) United States Patent
Chen et al.

(10) Patent No.: US 8,952,623 B2
(45) Date of Patent: Feb. 10, 2015

(54) MULTI-CHANNEL DRIVER EQUALIZER

(75) Inventors: Sean S. Chen, Sunnyvale, CA (US); Jeff Kotowski, Nevada City, CA (US); Timothy James Herklots, Cupertino, CA (US)

(73) Assignee: Atmel Corporation, San Jose, CA (US)

( * ) Notice: Subject to any disclaimer, the term of this patent is extended or adjusted under 35 U.S.C. 154(b) by 759 days.

(21) Appl. No.: 13/281,366

(22) Filed: Oct. 25, 2011

(65) Prior Publication Data

US 2013/0099697 A1 Apr. 25, 2013

(51) Int. Cl.
*H05B 41/16* (2006.01)

(52) U.S. Cl.
USPC ..... 315/247; 315/291; 315/307; 315/312; 315/185 S

(58) Field of Classification Search
USPC ..... 315/247, 224, 225, 307–326
See application file for complete search history.

(56) References Cited

U.S. PATENT DOCUMENTS

2010/0289424 A1* 11/2010 Chang et al. ..... 315/250
2014/0001978 A1* 1/2014 Lee ..... 315/297

* cited by examiner

*Primary Examiner* — Tuyet Thi Vo
(74) *Attorney, Agent, or Firm* — Fish & Richardson P.C.

(57) ABSTRACT

The disclosed multi-channel driver equalizer circuit matches currents in multiple strings of illumination devices at low current levels by using an analog equalizer to sequentially couple the output of a reference amplifier in series with each current source amplifier in a current limit loop of the driver equalizer circuit to correct the offsets of the current source amplifiers, resulting in the matching of string currents on average.

18 Claims, 3 Drawing Sheets

MULTI-CHANNEL DRIVER EQUALIZER

TECHNICAL FIELD

This disclosure relates generally to electronics and more particularly to Light Emitting Diode (LED) backlight and LED lighting.

BACKGROUND

In modern displays, white LEDs are used to create the white light used to backlight the LCD. It is desirable to have the ability to vary the level of the backlight used. This is desired for both maximizing contrast as well as adjusting the display to the ambient light level. Conventional LED driver circuits accomplish dimming by adjusting the on time (duty cycle) of an LED string, such that the percentage of on time creates an equivalent brightness (or average intensity) at the desired brightness.

FIG. 1 is a simplified schematic diagram of a conventional LED driver circuit for driving LED strings 102 with constant current. Operational amplifier 104 (Op1) compares the voltage across current sense resistor 108 (R1) with a reference voltage (Vref) to generate a command voltage on the gate of switching transistor 106 (T1). Vref is set at the desired voltage level for the desired LED current (Vref/R1) when the duty cycle is high. Vref is set to zero when the duty cycle is low.

Circuit 100 is commonly used because the voltage at the negative terminal of opamp 104 can be made much higher than the offset of opamp 104. Because the duty cycle controls the effective intensity for all intensity levels, the voltage at Vref is constant. Hence, we get good matching of LED string currents even at low intensity levels. A problem with circuit 100, however, is that circuit 100 places a burden on the power supply (Vsupply). Vsupply must respond to fast load changes caused by the fast edges on the duty cycle control of the LED string current. Accordingly, the conventional circuit 100 is accurate at low intensity and provides good matching on multiple LED strings, even at low intensity but creates a burden on Vsupply by requiring faster load response.

Some conventional methods modify Vref directly to set the desired brightness level for the LEDs. For example, if the value of Vref is set at 500 mV for full scale current, the value of Vref would change to 5 mV for 1% brightness. These conventional methods have the disadvantage of being susceptible to offset voltages at low currents. More important than absolute accuracy is the relative accuracy when multiple LED strings are used. Since the offsets of the current source amplifiers will not match, the currents in the LED strings will have poor matching at low current levels. Additionally, the switching transistors of the current sources must still be high voltage devices.

SUMMARY

The disclosed multi-channel driver equalizer circuit matches currents in multiple strings of illumination devices at low current levels by using an analog equalizer to sequentially couple the output of a reference amplifier in series with each current source amplifier in a current limit loop of the driver equalizer circuit to correct the offsets of the current source amplifiers, resulting in the matching of string currents on average.

Particular implementations of a multi-channel driver equalizer circuit can provide several advantages, including but not limited to: 1) lowering the transient response burden of the power supply; 2) allowing good matching of string currents on average at low current levels; and 3) allowing the manufacture of low cost driver chips.

The details of one or more disclosed implementations are set forth in the accompanying drawings and the description below. Other features, aspects, and advantages will become apparent from the description, the drawings and the claims.

DETAILED DESCRIPTION

Exemplary Multi-Channel Driver Equalizer Circuit

Figure 2A:
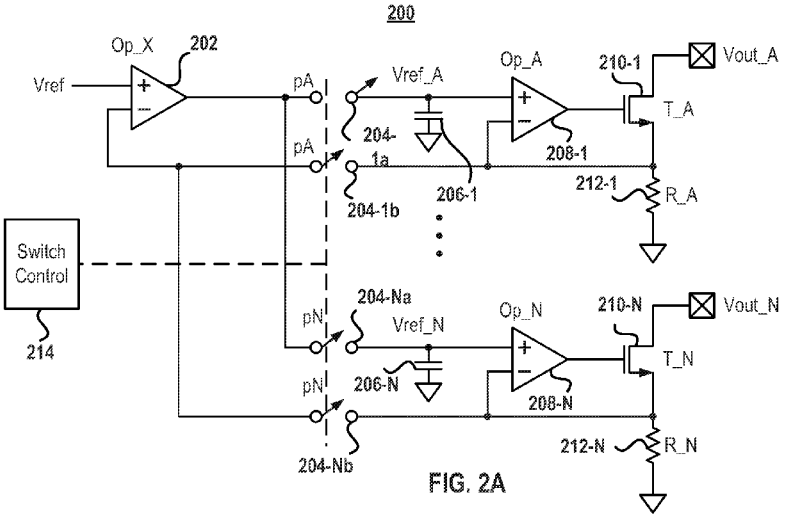
FIG. 2A is a simplified schematic diagram of an exemplary multi-channel driver equalizer circuit

FIG. 2A is a simplified schematic diagram of an exemplary multi-channel driver equalizer circuit 200. Circuit 200 can include reference amplifier 202 coupled through switch network 204 to N current sources in circuit 200. Each current source output (Vout) can be coupled to a string of illumination devices (e.g., LEDs). In circuit 200, two current sources are shown. Circuit 200, however, can include N current sources for N strings of illumination devices.

Figure 1:
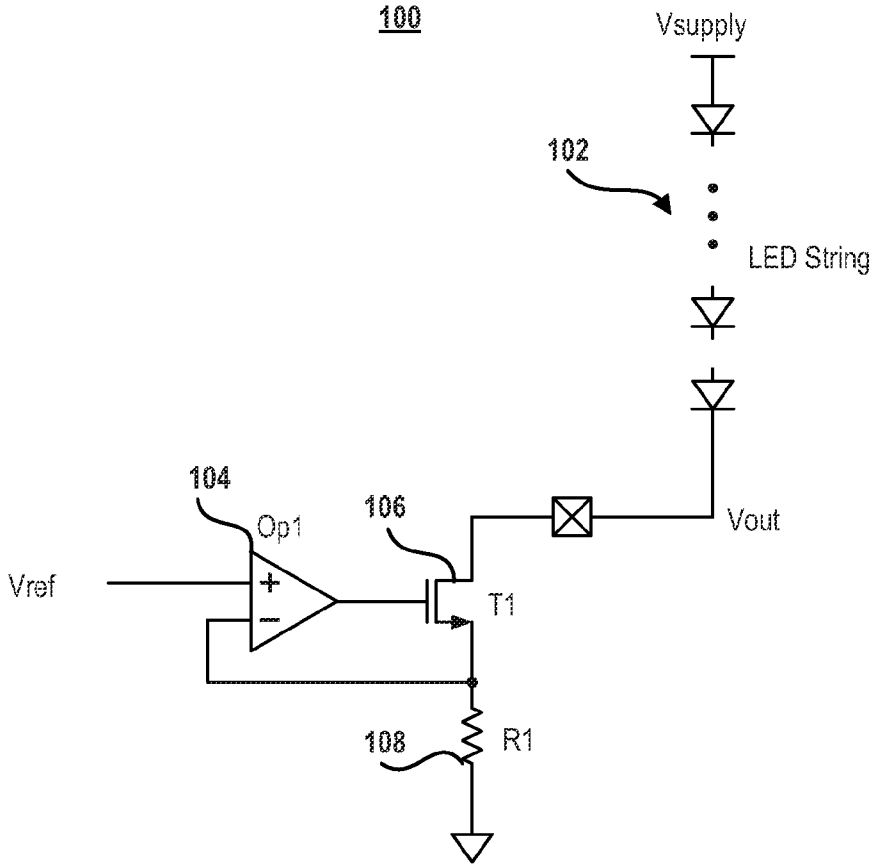
FIG. 1 (Prior Art)
FIG. 1 is a simplified schematic diagram of a conventional LED driver circuit for driving LEDs with a constant current.

Each current source includes hold capacitor 206, amplifier 208 (e.g., an operational amplifier), switch 210 and current sense resistor 212. The output of the current source (Vout) is coupled to string 102 (FIG. 1). The current source controls the change in current due to variations in forward voltage, which translates into a constant brightness of the illumination devices in the string. The input power supply Vsupply (FIG. 1) is regulated such that Vout on all of the current sources is high enough to maintain the desired current. The current source reference voltage (Vref) and the value of current sense resistor 212 determine the string current. Multiple strings can be connected in series to keep identical current flowing in each illumination device. The current source amplifiers 208 in circuit 200 have uncorrelated offsets. To equalize or eliminate those offsets, circuit 200 includes reference amplifier 202, switch network 204 and switch control 214, which operate as described below in reference to FIG. 2B.

Switch control 214 can provide commands to switches in switch network 214 to open and close switches 204. Switches 204 can be MOSFET transistors, or other suitable electronic devices. In some implementations, switch control 214 can be a state machine implemented by digital and/or analog circuits or a microprocessor to provide the waveforms of non-overlapping pulses shown in FIG. 2B.

Figure 2B:
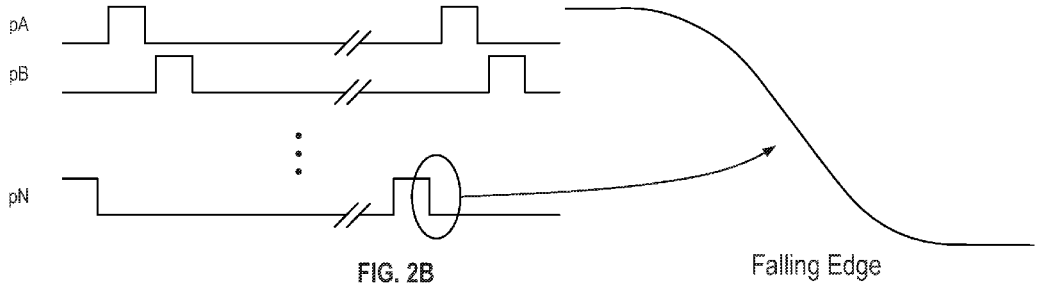
FIG. 2B illustrates exemplary waveforms for the circuit of FIG. 2A.

FIG. 2B illustrates exemplary waveforms for circuit 200 of FIG. 2A. During phase pA, switches 204-1*a*, 204-1*b* close, and reference amplifier 202 (Op_X) sets a local reference voltage (Vref_A) on holding capacitor 208-1, such that the offset seen at the output (Vout_A) of the current source is equivalent to the offset of reference amplifier 202.

On phase pB, switches 204-2*a*, 204-2*b* close and switches 204-1*a*, 204-1*b* open, and reference amplifier 202 sets a local reference voltage (Vref_B) on hold capacitor 206-2, such that the offset seen at the output (Vout_B) of the current source is equivalent to the offset of reference amplifier 202. This process continues sequentially in order for each current source in driver equalizer circuit 200 up to amplifier 208-N (Op_N). At that point, the process repeats and all of the strings are driven to equivalent offsets on average and have equivalent performance.

The process described above provides good matching of string currents event at low currents. If a low offset is needed for good absolute performance, only one opamp, Op_X, needs to be low offset.

In some implementations, each capacitor on the local Vref (Vref_A to Vref_N) will not exactly match. Secondly, the charge injection left by turning off switches 204 (pA to pN) will not exactly match each other. To minimize the individual offsets from charge injection, we can take advantage of the DC/continuous nature of the analog current limit. On each phase (pA to pN), charge injection from switch 204 is left on hold capacitor 206 (at Vref_A to Vref_N). The amount of charge left is dependent on the gate capacitance (Cgs). It is well known that minimizing the charge injection requires using a minimum-size switching transistor and a minimum gate drive. Both of these can be used for this application because of the low frequency nature of the offset correction. A second commonly used technique is to reduce slowly the gate voltage at turn-off of each phase, to provide the falling edge shown in FIG. 2B.

Using circuit 200 in combination with known offset reduction techniques allows a practical solution for reducing mismatch (and absolute error) to approximately 100 μV. Compared to conventional techniques alone, a multiple of improvement can be obtained of 10 to 50 in both matching and absolute performance. This allows a practical implementation of analog current dimming. For example, a full scale current may have 500 mV across current sense resistor 212. One percent current will have 5 mV of sense signal. With 100 μV of offset, we can maintain 2% accuracy due to offset.

Figure 3:
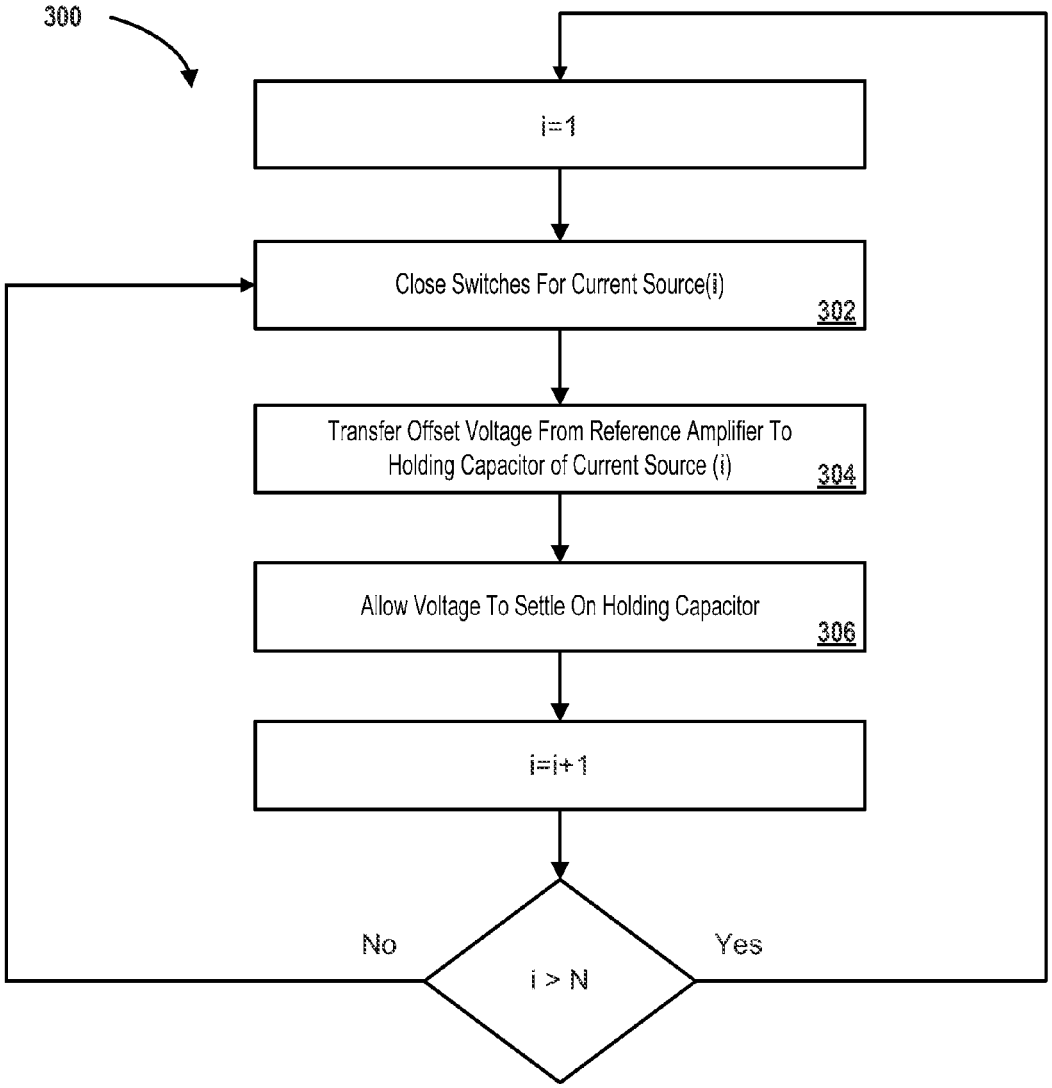
FIG. 3 is a flow diagram of an exemplary process for matching string currents at low current.

FIG. 3 is a flow diagram of an exemplary process 300 for matching string currents at low current. Process 300 can be implemented by circuit 200 described in reference to FIGS. 2A and 2B. Process 300 has the advantage of reducing the power supply transient requirements while good matching of string currents is maintained, even at low currents.

In some implementations, process 300 configures a switch network to couple a reference amplifier to a current source (302). The switch network can be configured by a switch control (e.g., state machine). Offset voltage is transferred from the reference amplifier to a holding capacitor of the current source (304). The reference amplifier can have a lower offset than the current source amplifier. The voltage is allowed to settle on the holding capacitor (306). The process is repeated for N current sources until all of the outputs of the current sources are driven to equivalent offsets on average.

While this document contains many specific implementation details, these should not be construed as limitations on the scope what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A circuit comprising:

a reference amplifier having an offset;

a plurality of current sources configured for coupling to a string of illumination devices, each current source including an amplifier for comparing a sensed current flowing through the string of illumination devices and a reference voltage, and controlling the flow of current through the string of illumination devices based on the comparing; and a switch network configured for coupling the reference amplifier to each current source in an ordered sequence, resulting in an offset of the current source amplifier being made equivalent to the offset of the reference amplifier on average.

2. The circuit of claim 1, where the reference amplifier has a lower offset than the amplifiers of the current sources.

3. The circuit of claim 1, where the illumination devices are Light Emitting Diodes.

4. The circuit of claim 1, where each current source further comprises:

a transistor having a gate terminal coupled to the output of the amplifier and a source terminal configured for coupling to the string of illumination devices;

a holding capacitor coupled to a non-inverting input of the amplifier; and a sense resistor coupled to the drain of the transistor and the inverting input of the amplifier.

5. The circuit of claim 4, further comprising:

a switch control circuit coupled to the switch network and configured for generating commands to the switch network, for opening and closing switches in the switch network according to the ordered sequence.

6. The circuit of claim 5, where switches in the switch network are transistors and the switch control circuit controls the rate at which the switches close to reduce the amount of charge stored by the switch stored on the holding capacitor.

7. A method comprising:

during a first phase, coupling an output of a reference amplifier having a first offset to inputs of a second amplifier in a first current source configured for driving a first string of illumination devices coupled to the first current source, the output of the first current source having an offset that is equivalent to the first offset of the reference amplifier; and during a second phase following the first phase, coupling the output of the reference amplifier to inputs of a third amplifier in a second current source configured for driving a second string of illumination devices coupled to the second current source, the output of the second current source having an offset that is equivalent to the first offset of the reference amplifier, where a first current supplied by the first current source substantially matches a second current supplied by the second current source on average.

8. The method of claim 7, where the reference amplifier has a lower offset than the first and second amplifiers.

9. The circuit of claim 7, where the illumination devices are Light Emitting Diodes.

10. The method of claim 7, where the first current source further comprises:

a transistor having a gate terminal coupled to the output of the second amplifier and a source terminal configured for coupling to the string of illumination devices;

a holding capacitor coupled to a non-inverting input of the second amplifier; and a sense resistor coupled to the drain of the transistor and the inverting input of the second amplifier.

11. The method of claim 10, further comprising:

generating commands to a switch network coupled between the reference amplifier and the second amplifier for closing switches in the switch network to couple the reference amplifier to the second amplifier.

12. The circuit of claim 11, where switches in the switch network are transistors and the switch control circuit controls the rate at which the switches close to reduce charge stored by the switch transferring to the holding capacitor.

13. A display panel comprising:

a plurality of strings of illumination devices; and a driver equalizer circuit coupled to the plurality of strings of illumination devices, the driver equalizer circuit comprising:

a reference amplifier having an offset;

a plurality of current sources configured for coupling to the strings of illumination devices, each current source including an amplifier for comparing a sensed current flowing through the string of illumination devices and a reference voltage, and controlling the flow of current through the string of illumination devices based on the comparing; and a switch network configured for coupling the reference amplifier to each current source in an ordered sequence, resulting in an offset of the current source amplifier being made equivalent to the offset of the reference amplifier on average.

14. The display panel of claim 13, where the reference amplifier has a lower offset than the amplifiers of the current sources.

15. The display panel of claim 13, where the illumination devices are Light Emitting Diodes.

16. The display panel of claim 13, where each current source further comprises:

a transistor having a gate terminal coupled to the output of the amplifier and a source terminal configured for coupling to the string of illumination devices;

a holding capacitor coupled to a non-inverting input of the amplifier; and a sense resistor coupled to the drain of the transistor and the inverting input of the amplifier.

17. The display panel of claim 16, further comprising:

a switch control circuit coupled to the switch network and configured for generating commands to the switch network, for opening and closing switches in the switch network according to the ordered sequence.

18. The display panel of claim 17, where switches in the switch network are transistors and the switch control circuit controls the rate at which the switches close to reduce the amount of charge stored by the switch stored on the holding capacitor.

* * * * *

UNITED STATES PATENT AND TRADEMARK OFFICE

CERTIFICATE OF CORRECTION

PATENT NO. : 8,952,623 B2
APPLICATION NO. : 13/281366
DATED : February 10, 2015
INVENTOR(S) : Sean S. Chen, Jeffrey P. Kotowski and Timothy James Herklots It is certified that error appears in the above-identified patent and that said Letters Patent is hereby corrected as shown below:

In the Specification

Col. 2, line 13, delete “circuit” and insert -- circuit. --, therefor.

In the Claims

Col. 4, line 59, Claim 9, delete “circuit” and insert -- method --, therefor.

Col. 5, line 8, Claim 12, delete “circuit” and insert -- method --, therefor.

Signed and Sealed this
Twenty-sixth Day of May, 2015

Michelle K. Lee

Michelle K. Lee
*Director of the United States Patent and Trademark Office*